US009309634B2

(12) United States Patent
Grace

(10) Patent No.: US 9,309,634 B2
(45) Date of Patent: Apr. 12, 2016

(54) CONTINUOUS CFRP DECKED BULB T BEAM BRIDGES FOR ACCELERATED BRIDGE CONSTRUCTION

(71) Applicant: Nabil F. Grace, Rochester Hills, MI (US)

(72) Inventor: Nabil F. Grace, Rochester Hills, MI (US)

(73) Assignee: Lawrence Technological University, Southfield, MI (US)

( * ) Notice: Subject to any disclaimer, the term of this patent is extended or adjusted under 35 U.S.C. 154(b) by 0 days.

(21) Appl. No.: 13/858,571

(22) Filed: Apr. 8, 2013

(65) Prior Publication Data

US 2013/0269125 A1 Oct. 17, 2013

Related U.S. Application Data

(60) Provisional application No. 61/621,104, filed on Apr. 6, 2012.

(51) Int. Cl.
*E01D 19/12* (2006.01)
*E01D 2/02* (2006.01)
*E01D 101/28* (2006.01)

(52) U.S. Cl.
CPC ..... *E01D 19/125* (2013.01); *E01D 2/02* (2013.01); *E01D 2101/28* (2013.01)

(58) Field of Classification Search
CPC ... E01D 101/24; E01D 101/26; E01D 101/28; E01D 2101/24; E01D 2101/26; E01D 2101/28
USPC ..... 52/223.8, 223.9, 223.11; 14/74.5
See application file for complete search history.

(56) References Cited

U.S. PATENT DOCUMENTS 960,305 A * 6/1910 Gilbreth ..... 52/223.11
2,101,538 A 12/1937 Faber
3,398,498 A 8/1968 Krauss
3,906,687 A 9/1975 Schupack
3,909,863 A 10/1975 Macrander et al.
4,185,440 A * 1/1980 Finsterwalder ..... 52/745.19
4,366,655 A 1/1983 Mayer et al.
4,453,283 A 6/1984 Fitzgerald-Smith et al.
4,620,400 A 11/1986 Richard
4,704,754 A 11/1987 Bonasso
4,710,994 A 12/1987 Kishida et al.
5,437,072 A 8/1995 Dinis et al.
5,457,839 A 10/1995 Csagoly
5,784,739 A 7/1998 Kawada et al.
5,896,609 A 4/1999 Lin
6,065,257 A 5/2000 Nacey et al.

(Continued)

OTHER PUBLICATIONS http://www.fhwa.dot.gov/publications/research/infrastructure/structures/hpc/13060/13060.pdf "Ultra-High Performance Concrete: A State-of-the-Art Report for the Bridge Community," Publication No. FHWA-HRT-13-060, U.S. Department of Transportation Federal Highway Administration, Jun. 2013.*

Ozyildirim, Celik, http://www.virginiadot.org/vtrc/main/online_reports/pdf/12-r1.pdf "Evaluation of Ultra-High-Performance Fiber-Reinforced Concrete," Virginia Center for Transportation Innovation & Research, Aug. 2011.*

Technote "Construction of Field-Cast Ultra-High Performance Concrete Connections," FHWA Publication No. FHWA-HRT-12-038, U.S. Department of Transportation Federal Highway Administration, Apr. 2012.*

(Continued)

*Primary Examiner* — Gary Hartmann
(74) *Attorney, Agent, or Firm* — Dickinson Wright PLLC

(57) ABSTRACT

A pre-stressed concrete bridge using longitudinal load members of a single continuous beam including at least two types of concrete, one of which is ultra-high-performance concrete (UHPC) mix with a compressive strength exceeding 137.9 Mpa (20 ksi) and tensile strength exceeding 10.34 Mpa (1.5 ksi) in a region proximate to the support structure.

19 Claims, 6 Drawing Sheets

(56) References Cited

U.S. PATENT DOCUMENTS

| | | | | |
|---|---|---|---|---|
| 6,138,309 | A | 10/2000 | Tadros et al. | |
| 6,145,270 | A | 11/2000 | Hillman | |
| 6,176,051 | B1 | 1/2001 | Sorkin | |
| 6,345,403 | B1 | 2/2002 | Nagle | |
| 6,751,821 | B1 | 6/2004 | Han | |
| 6,790,518 | B2 | 9/2004 | Grace et al. | |
| 6,832,454 | B1 | 12/2004 | Iyer | |
| 6,857,156 | B1 | 2/2005 | Grossman | |
| 7,296,317 | B2 | 11/2007 | Grace | |
| 7,373,683 | B2 | 5/2008 | Moon | |
| 7,475,446 | B1 | 1/2009 | He | |
| 7,901,504 | B2 * | 3/2011 | Batoz et al. | 106/644 |
| 8,020,235 | B2 | 9/2011 | Grace | |
| 8,316,495 | B2 * | 11/2012 | He | 14/77.1 |
| 8,650,819 | B2 * | 2/2014 | Yegge | 52/223.14 |
| 8,656,685 | B2 * | 2/2014 | Wu | 52/847 |
| 2004/0216249 | A1 | 11/2004 | El-Badry | |
| 2005/0097686 | A1 | 5/2005 | Royer | |

OTHER PUBLICATIONS

Techbrief "Field-Cast UHPC Connections for Modular Bridge Deck Elements," FHWA Publication No. FHWA-HRT-11-022, U.S. Department of Transportation Federal Highway Administration, Nov. 2010. http://www.fhwa.dot.gov/publications/research/infrastructure/structures/11022/11022.pdf.*

Ultra-High Performance Concrete: A State-of-the-Art Report for the Bridge Community, Publication No. FHWA-HRT-13-060, U.S. Department of Transportation Federal Highway Administration, Jun. 2013.*

New York State Department of Transportation (NYSDOT) Bridge Design Sheets BD-PA3 to BD-PA5 (Prestressed Concrete Box Beams) issued Jan. 26, 2005 by the NYSDOT Chief Engineer (Structure) to provide guidelines for NYSDOT standards of bridge design.

Saito, M., "Carbon Fiber Composites in the Japanese Civil Engineering Market—Conventional Uses and Developing Products," SAMPE Journal, vol. 38, No. 5, Sep./Oct. 2002, pp. 20-25.

Nippon Steel Composite Co., Ltd. Brochure—FRP Grid FORCA Towgrid (4 pages).

Nefcom Corporation Brochure—FRP Reinforcing Bar NEFMAC (4 pages).

Ozyildirim, Celik, Ph.D., P.E., Evaluation of Ultra-High-Performance Fiber-Reinforced Concrete, Final Report Virginia Center for Transportation Innovation and Research 12-R1, Aug. 2011, 25 pages.

Grace, Nabil F., et al., Design-Construction of Bridge Street Bridge—First CFRP Bridge in the United States; PCI Journal; Sep.-Oct. 2002; pp. 20-35.

Grace, Nabil F., et al., Development and Application of Innovative Triaxially Braided Ductile FRP Fabric for Strengthening Concrete Beams; Science Direct; Composite Structures 64; Sep. 2003; pp. 521-530; Elsevier Ltd.

Grace, Nabil F., et al., Behavior of CFCC and CFRP Leadline Prestressing Systems in Bridge Construction; PCI Journal; May-Jun. 2002; pp. 90-103.

Special Award Winners; Harry H. Edwards Industry Advancement Award, Co-Winner; Ascent; Fall 2002; pp. 6-8 and 10.

First CFRP Bridge in the USA Michigan Researchers and Consultants Using Tomorrow's Technology Today; C&T Research Record; Feb. 2003; pp. 1-4; Issue No. 97; Michigan Department of Transportation's Construction and Technology Division.

Grace, Nabil F. et al.; Full-Scale Test of Prestressed Double-Tee Beam; Concrete International; Apr. 2003; pp. 52-58.

Grace, Nabil F.; Strengthening of Negative Moment Region of Reinforced Concrete Beams Using Carbon Fiber-Reinforced Polymer Strips; ACI Structural Journal; May-Jun. 2001; pp. 347-358; Title No. 98-S33.

Grace, Nabil F.; Improved Anchoring System for CFRP Strips; Concrete International; Oct. 2001; pp. 55-60.

Grace, Nabil F. et al.; Durability Evaluation of Carbon Fiber-Reinforced Polymer Strengthened Concrete Beams: Experimental Study and Design; ACI Structural Journal; Jan.-Feb. 2005; pp. 40-53; Title No. 102-S05.

Grace, Nabil F. et al.; Strengthening of Concrete Beams Using Innovative Ductile Fiber-Reinforced Polymer Fabric; ACI Structural Journal; Sep.-Oct. 2002; pp. 692-700; Title No. 99-S71.

Grace, Nabil F. et al.; Concrete Foundation for a Truck and Bus Road Test Stimulator; Concrete International; Jan. 1995; pp. 35-41.

Svaty, Jr., Karl J. et al.; City of Wichita Implements Pioneering Rehab Technologies; 5 pgs.

McCraven, Sue, Taking Precast Concrete to the Limit; Precast, Inc. Magazine; Jan.-Feb. 2009; pp. cover and 16-19; NCPA.

Grace, Nabil F., et al., Transverse Diaphragms and Unbonded CFRP Post-Tensioning in Box-Beam Bridges; PCI Journal; Spring 2010; pp. 1-14.

Grace, Nabil F., Response of Continuous CFRP Prestressed Concrete Bridges Under Static and Repeated Loadings; PCI Journal; Nov.-Dec. 2000; pp. 84-102.

Grace, Nabil F. et al.; Strengthening Reinforced Concrete Beams Using Fiber Reinforced Polymer (FRP) Laminates; ACI Structural Journal; Sep.-Oct. 1999; pp. 865-875; Title No. 96-S95.

Grace, Nabil F.; Continuous CFRP Prestressed Concrete Bridges; Concrete International; Oct. 1999; pp. 42-47.

Prototype CFRP/CFCC Precast Prestressed Girder Successfully Tested; PCI Journal; Nov.-Dec. 2000; pp. 119-130.

Grace, Nabil F., et al., Flexural Behavior of Precast Concrete Box Beams Post-Tensioned With Unbonded, Carbon-Fiber-Composite Fibers; PCI Journal; Jul.-Aug. 2008; pp. 62-82.

Grace, Nabil F. et al.; Double Tee and CFRP/GFRP Bridge System; Concrete International; Feb. 1996; pp. 39-44.

Grace, Nabil F., et al., Behavior and Ductility of Simple and Continuous FRP Reinforced Beams; Journal of Composites for Construction; Nov. 1998; pp. 186-194.

Grace, Nabil F., Fiber Reinforced Polymers; Precast Solutions; Sep.-Oct. 2008; pp. cover 8-14.

Grace, Nabil F., Materials for the Future: Innovative Uses for FRP Materials for Construction; Technology Century; Summer 2002; pp. 26-29.

Grace, Nabil F., New Ideas Shape the Industry: Innovative Uses for FRP Materials for Construction; Technology Century; May-Jun. 2002; pp. 26-29.

Grace, Nabil F. et al.; Resonance/Vibration Problem of Deep Foundation; Concrete International; Jan. 1997; pp. 26-32.

Grace, Nabil F., et al., Truck Load Distribution Behavior of the Bridge Street Bridge, Southfield, Michigan; PCI Journal; Mar.-Apr. 2005; pp. 2-15.

Grace, Nabil F., et al., Behavior of Externally Draped CFRP Tendons in Prestressed Concrete Bridges; PCI Journal; Sep.-Oct. 1998; pp. 88-101.

Grace, Nabil F. et al.; Design Approach for Carbon Fiber-Reinforced Polymer Prestressed Concrete Bridge Beams; ACI Structural Journal; May-Jun. 2003; pp. 365-376; Title No. 100-S40.

Grace, Nabil F., et al., Experimental Study and Analysis of a Full-Scale CFRP/CFCC Double-Tee Bridge Beam; PCI Journal; Jul.-Aug. 2003; pp. 120-139.

Grace, Nabil F., et al., Flexural Response of CFRP Prestressed Concrete Box Beams for Highway Bridges; PCI Journal; Jan.-Feb. 2004; pp. 92-104.

Grace, Nabil F.; Concrete Repair With CFRP; Concrete International; May 2004; pp. 45-52.

Grace, Nabil F. et al.; Load Testing a CFRP-Reinforced Bridge; Concrete International; Jul. 2004; pp. 1-7.

Grace, Nabil F. et al.; Ductile FRP Strengthening Systems; Concrete International; Jan. 2005; pp. 31-36.

Grace, Nabil F. et al.; Concrete Beams Reinforced With CFRP; Concrete International; Feb. 2005; pp. 1-5.

Rohleder, Jr., W. Jay et al.; CFRP Strand Application on Penobscot Narrows Cable Stayed Bridge; pp. 1-15.

* cited by examiner

CONTINUOUS CFRP DECKED BULB T BEAM BRIDGES FOR ACCELERATED BRIDGE CONSTRUCTION

CROSS REFERENCE TO RELATED APPLICATIONS

This U.S. Patent Application claims the benefit of U.S. Provisional Patent Application Ser. No. 61/621,104, entitled "Continuous CFRP Decked Bulb T Beam Bridges For Accelerated Bridge Construction", filed Apr. 6, 2012, the entire disclosure of the application being considered part of the disclosure of this application, and hereby incorporated by reference.

BACKGROUND OF THE INVENTION

The present invention is generally directed to a bridge and more particularly, to an improved pre-stressed, concrete bridge using longitudinal load members of a single continuous beam including at least two types of concrete, one of which is ultra-high-performance concrete (UHPC) mix with a compressive strength exceeding 137.9 Mpa (20 ksi) and tensile strength exceeding 10.34 Mpa (1.5 ksi) in a region proximate to the support structure.

Engineers are consistently striving to build bridges that are stronger, lighter, and capable of spanning longer distances while having improved durability and lower costs. Increasing the distance that a bridge may span without supporting piers or increasing the distance between supporting piers is also very desirable. To accomplish the above goals, engineers over the years have moved from stone and wood bridges to iron and steel bridges, to reinforced concrete bridges and more recently to pre-stressed concrete bridges.

Pre-stressed concrete bridges using pre-stressed beams have been widely implemented in the bridge construction in the last couple of decades. Prestressed beams are favored over steel or reinforced concrete beams because of their high load carrying capacities and their high span-to-depth ratio. However, certain deficiencies have been recently reported in prestressed beams such as: (1) cracking near the ends of the beams at the anchorage zones, (2) web distress and shear cracking, and (3) spalling of concrete and other durability issues associated with the corrosion of the longitudinal and transverse steel reinforcement. FIG. 1 shows an exemplary prestressed beam including a steel reinforcement shear plate.

In addition, unlike steel or reinforced concrete beams, continuity of prestressed beams is relatively hard to accomplish. Usually, prestressed beams are designed as simply supported for dead loads and continuous for life loads. The continuity for the life loads are typically achieved by providing a continuous cast-in-place deck slab. Nevertheless, the addition of cast-in-place deck slabs prolongs the on-site construction time and encounters further traffic interruption. In addition, the cast-in-place deck slab hinders the wide implementation of accelerated bridge construction (ABC) technique, which is developed primarily to expedite the bridge construction process, reduce the on-site construction work, and improve the quality and lifespan of the constructed bridges. ABC technique involves constructing precast concrete units off-site then transporting them to the construction site where they are interconnected together using cold construction joints and/or prestressing system.

While some have attempted to solve the above problems using Ultra-high-performance concrete (UHPC) or Ultra-High-Performance Fiber-Reinforced Concrete (UHPFRC), for the complete beams, these have been found to have their own issues, particularly with problems of quality control and exceptional high cost. More specifically as provided in "EVALUATION OF ULTRA-HIGH-PERFORMANCE FIBER-REINFORCED CONCRETE"by Celik Ozyildirim, Ph.D., P.E. of the Virginia Center for Transportation Innovation & Research, August 2011, "VDO's Structure and Bridge Division should not use UHPC because of its high cost" and further specifies that UHPC is not practical for use in bridges. Therefore, while UHPC has positive performance characteristics, the problems with quality control and high cost have prevented its adaption as a bridge material in the industry. As further provided in Nebraska Department of Roads Project Number: P310 "APPLICATION OF ULTRA-HIGH PERFORMANCE CONCRETE TO BRIDGE GIRDERS" by Maher K. Tadros and George Morcous, February 2009, commercial UHPC mixes cost ten times conventional mixes, and need special mixing and curing procedures that are not convenient to precasters, all of which "represent serious obstacle towards its wide use in practical and economical bridge applications". Therefore, there is a need for the performance of UHPC, without the associated costs of UHPC, as well as a way to minimize the difficulty of pouring a beam having expected performance characteristics.

SUMMARY OF THE INVENTION

The present invention is generally directed to a bridge and more particularly, to an improved pre-stressed, concrete bridge using longitudinal load members of a single continuous beam including at least two types of concrete, one of which is ultra-high-performance concrete (UHPC) mix with a compressive strength exceeding 137.9 Mpa (20 ksi) and tensile strength exceeding 10.34 Mpa (1.5 ksi)in a region proximate to the support structure and intermediate sections between the support structure of bridge concrete or high purity concrete having a compressive strength exceeding 137.9 Mpa (20 ksi) and tensile strength exceeding 10.34 Mpa (1.5 ksi), typically 68.95-96.53 Mpa (10-14 ksi) compressive strength.

The bridge includes a longitudinal load member including a first and a second section being formed substantially out of UHPC and an intermediate section between the first and second section not being formed out of UHPC. The longitudinal load members include a plurality of longitudinally extending internal tendons along predetermined paths and the internal tendons include at least one tendon extending along a first predetermined path.

The first predetermined path passes through the first intermediate section along a first travel path and through the first section along a second travel path. The first and the second travel paths are angled relative to each other and are not parallel. The first predetermined path includes a third travel path through the second section and the third travel path is angled relative to both of the first travel path and the second travel path. The first predetermined path includes a fourth travel path in at least one of the first and second sections. The fourth travel path is angled relative to the second and third travel paths. The fourth travel path is substantially parallel to the first travel path.

The bridge includes a support structure having at least one abutment and at least one of the first and second sections rests on the abutment. The support structure may also include at least one pier. At least one of the first and the second sections rests on the pier. It should be recognized that the beam or longitudinal load member may extend across multiple piers, providing additional sections of UHPC and additional intermediate sections between at least two contiguous sections of UHPC. However, each span will generally include a first section of UHPC, followed by an intermediate section of non-UHPC concrete, followed by the second section of UHPC. If a support pier is used, and the longitudinal load member extends in a single contiguous beam across the pier, the second section of UHPC, will act as the first section of UHPC for the next span, typically with the UHPC being centered about the pier. If precast, the only limits to the length and number of spans may be the difficulties in transporting the load member to the bridge site. The intermediate section is not supported by the support structure, and any sections that are not formed out of UHPC are not placed above any of the support structure.

The UHPC concrete has a compressive strength exceeding 137.9 Mpa (20 ksi) and tensile strength exceeding 10.34 Mpa (1.5 ksi). The internal tendons are typically a carbon fiber, such as a carbon fiber reinforced polymer (CFRP). The internal tendons may include a second predetermined path that is substantially straight. Of course, multiple first pathways and second pathways may be included in a single longitudinal load member. Each first pathway will be substantially parallel to each other and preferable at least two of the first pathways in the same plane, with the only deviations from parallel, other than minor unintended deviations or within a 2-3 degrees of alignment, occurring where the pathways change directions, and by their stacked nature, one will naturally have to extend a longer or shorter distance than the other. As stated above, the first pathways will generally all be in the same plane, for a t-beam, while a double t-beam or pi beam will have at least two planes of first pathways.

The second predetermined pathway is generally straight. At least two of said second pathways may be in each of two planes in the longitudinal load member. The second predetermined path is substantially parallel to the second and the fourth travel paths.

The intermediate section of the bridge is formed from a concrete having a compressive strength less than 137.9 Mpa (20 ksi) and tensile strength less than 10.34 Mpa (1.5 ksi), preferably a compressive strength of 68.95-96.53 Mpa (10-14 ksi). The internal tendons are prestressed tendons, although some may be post stressed. Any transverse tendons passing through multiple load members are expected to be post-stressed, or added and stressed after installation of the longitudinal load members at the bridge site.

The longitudinal load members may be formed from hybrid decked bulb t-beams, hybrid decked bulb double t-beams and hybrid decked pi beams. The longitudinal load members may form the traffic surface and as such, when constructed the bridge is free of a separate cast in place deck slab, allowing vehicles and traffic to travel directly on the longitudinal load members. It is expected that the intermediate section forms no more than 70%, preferably no more than 80% and yet more preferably no more than 85% of the longitudinal load members. Similarly, it is expected that the UHPC sections will typically not exceed more than 30%, preferably 20% and even more preferably less than 15% of the length of the longitudinal load members.

Further scope and applicability of the present invention will become apparent from the following detailed description, claims and drawings. However, it should be understood that the specific examples in the detailed description are given by way of illustration only, since various changes and modifications within the spirit and scope of the invention will become apparent to those skilled in the art.

DETAILED DESCRIPTION

Proposed Solution

Figure 1:
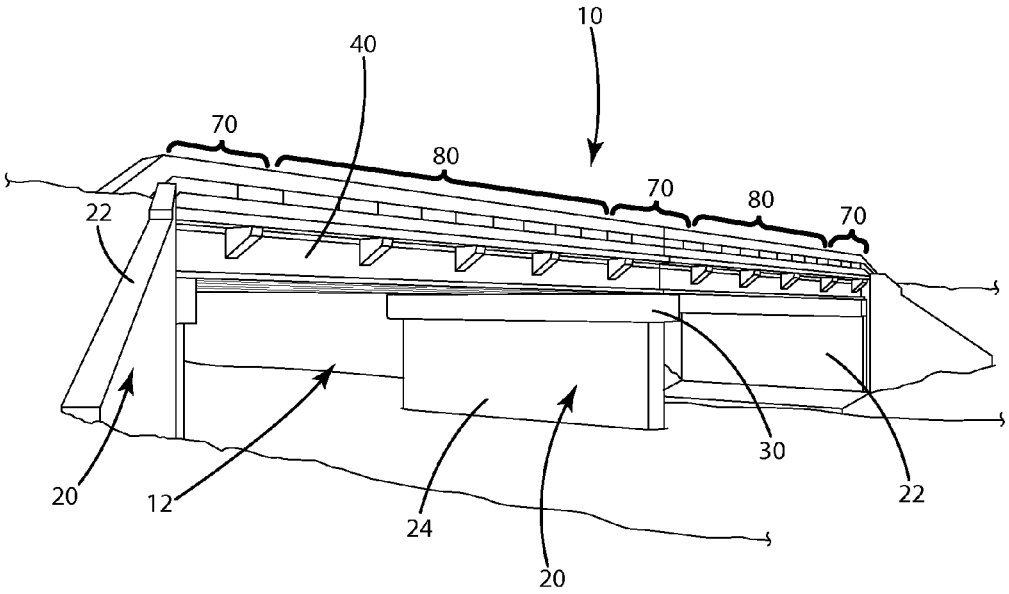
Fig. 1 (Prior Art)
FIG. 1 is a perspective view of a bridge.
Figure 2:
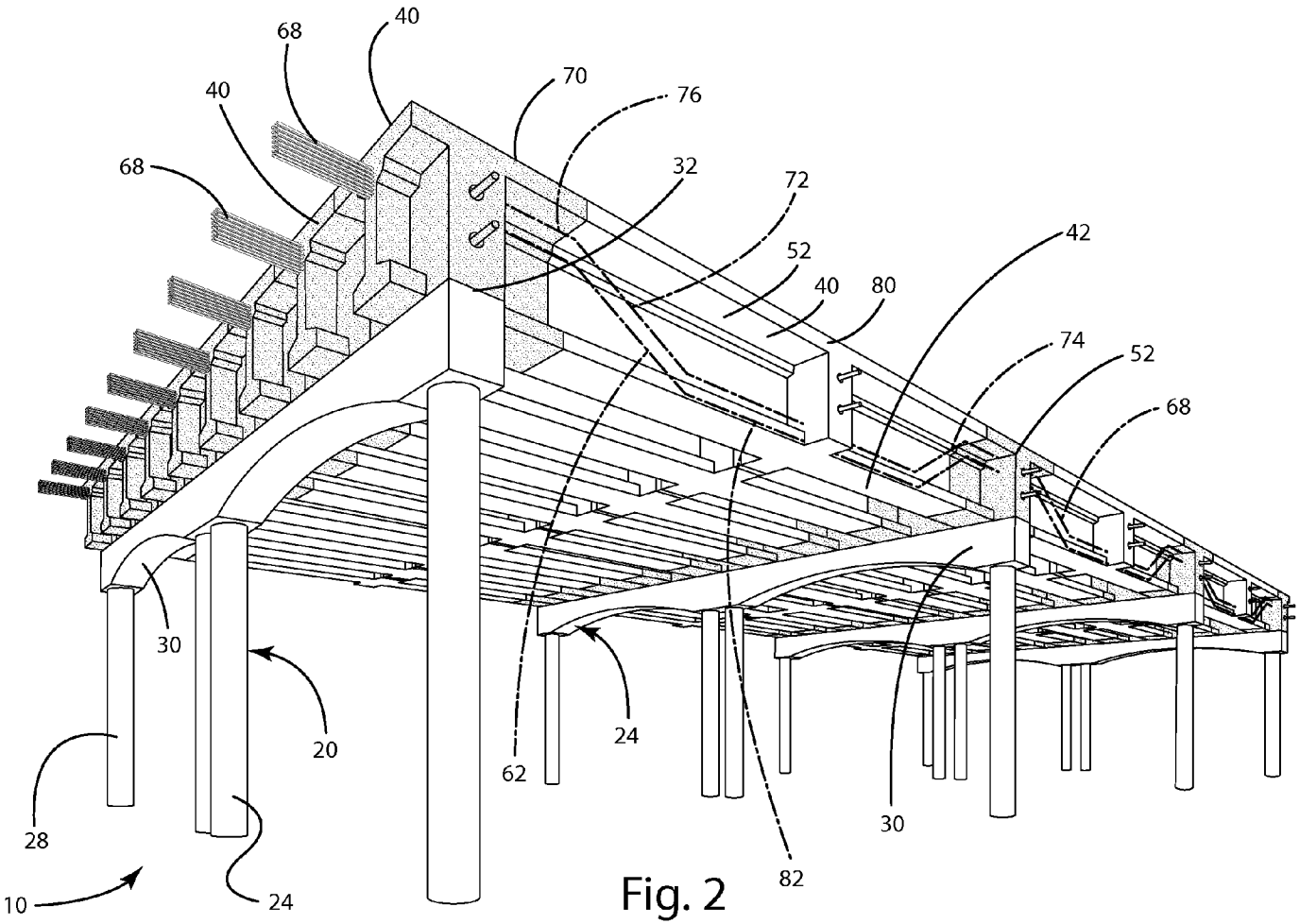
FIG. 2 is a lower perspective view of a bridge assembled using prestressed concrete t-beams free from shear plates and forming the bridge deck.
Figure 3:
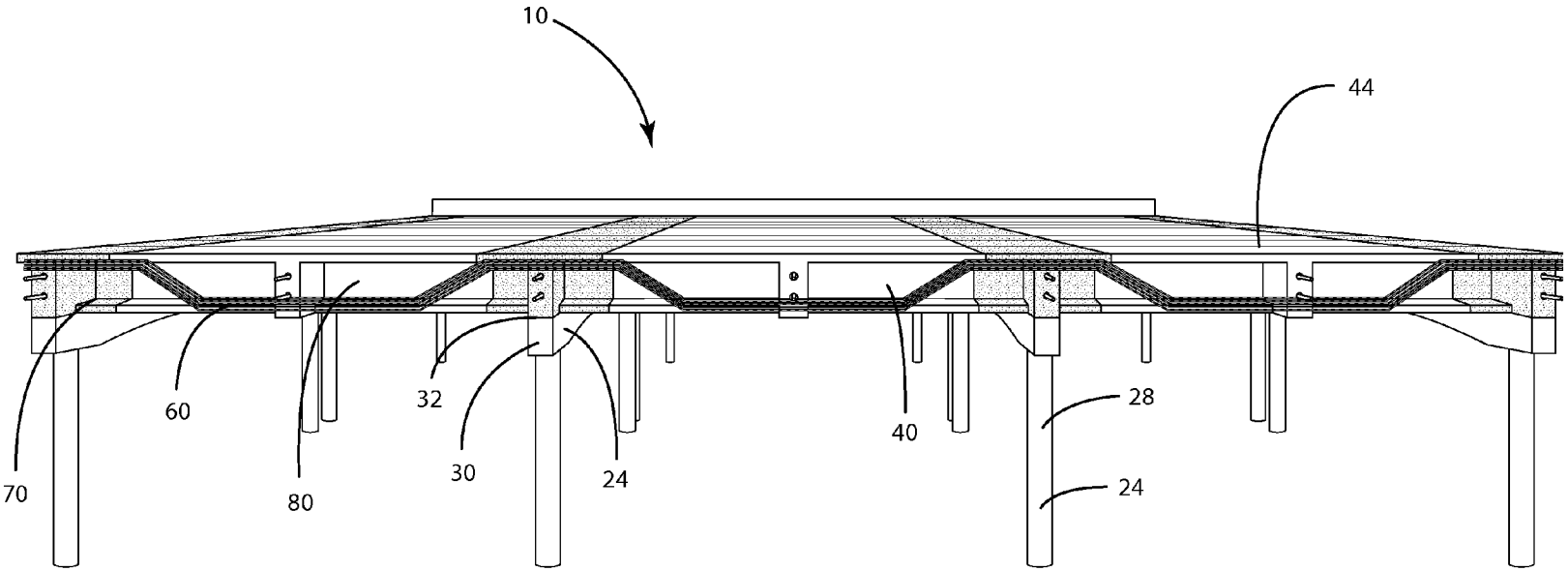
FIG. 3 is an upper perspective view of a the bridge in FIG. 2
Figure 4:
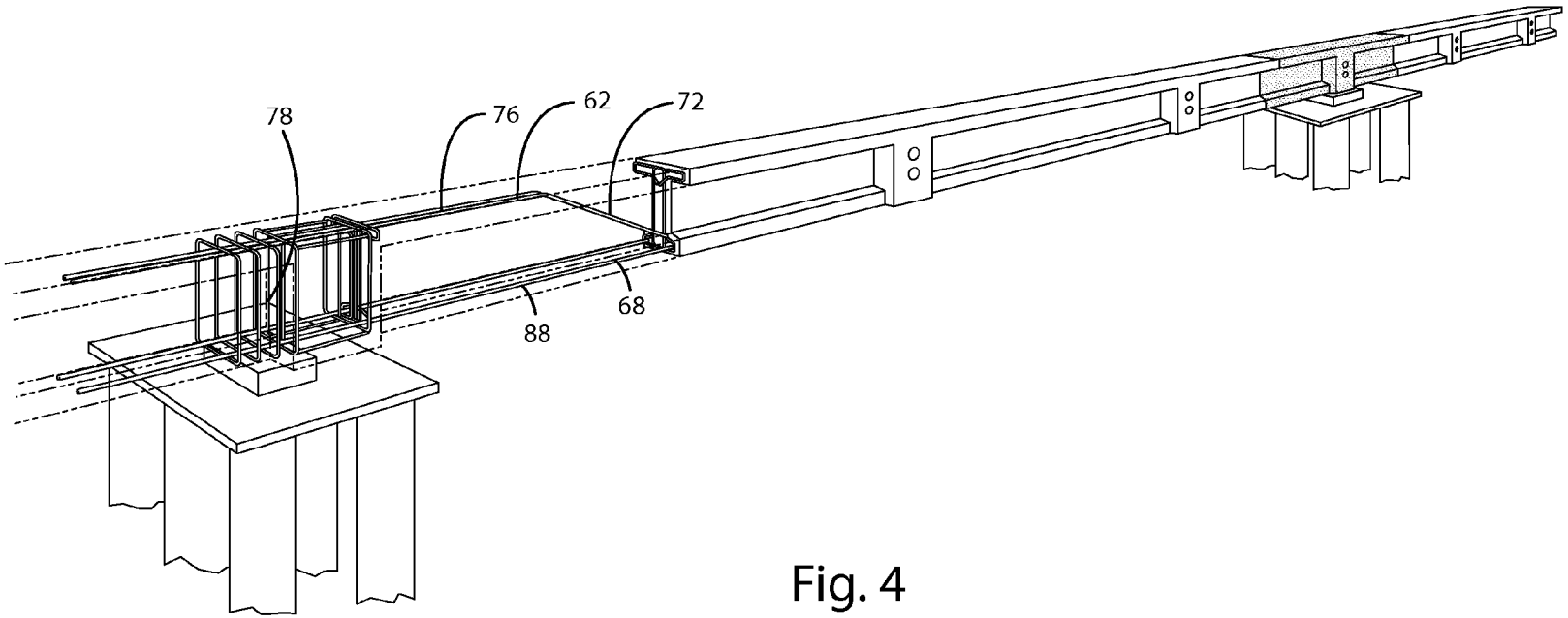
FIG. 4 is an upper perspective cross sectional view of a t-beam showing standard concrete in solid and UHPC concrete portions being removed over the piers to show routing of CFRP strands.
Figure 5:
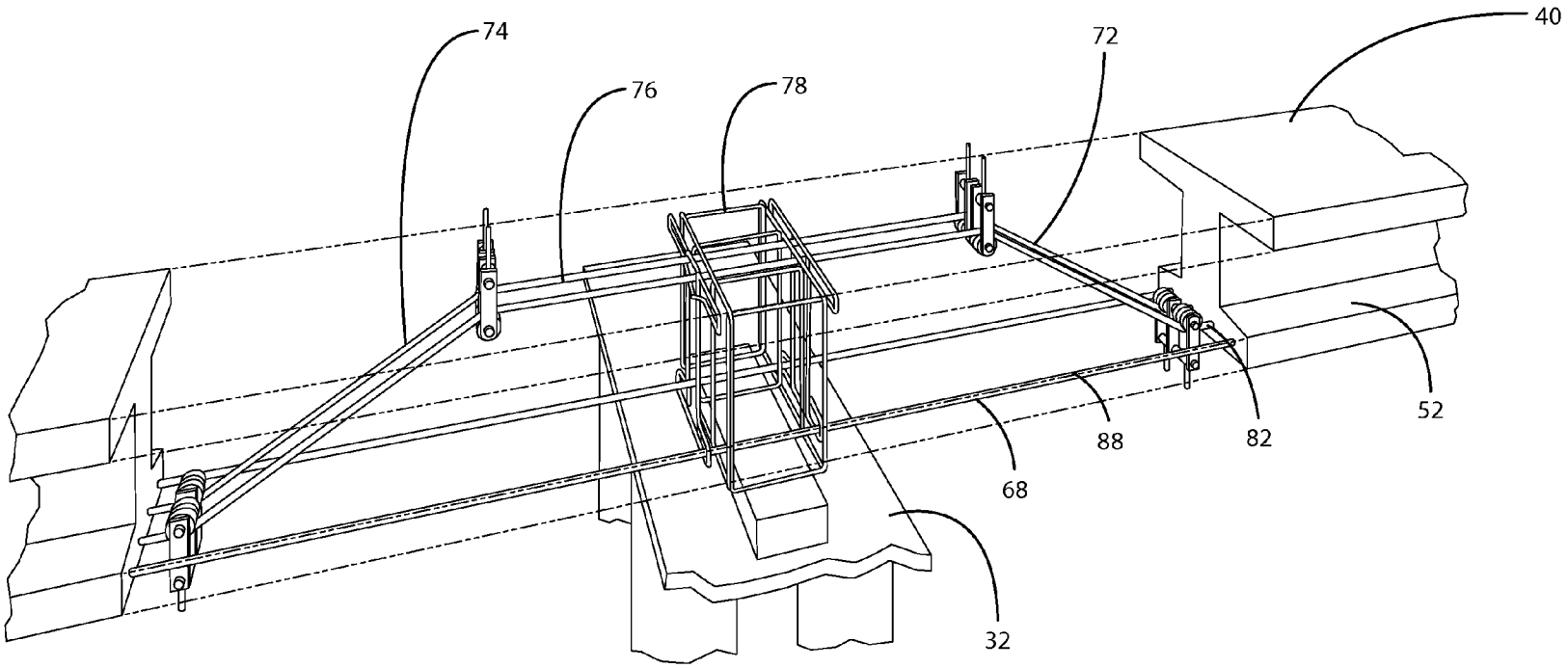
FIG. 5 is an enlarged partial cross sectional view of the t-beam and pier, with the portion of UHPC concrete removed showing routing of the CFRP strands.
Figure 6:
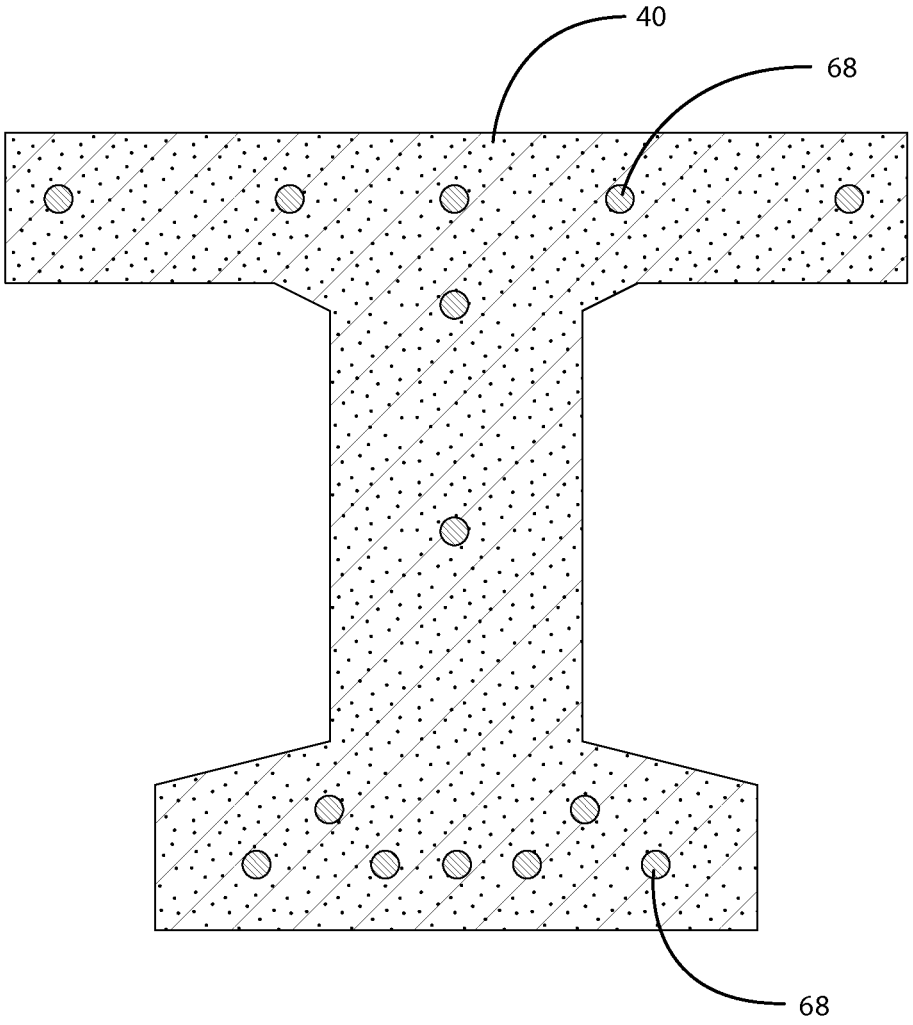
FIG. 6 is a cross-section view of a t-beam.

The present invention is directed to a bridge 10, generally illustrated in FIGS. 2 and 3. The bridge 10 is supported by a support structure 20 which supports longitudinal load members 40, also referred to as beams, which also form the deck 132 or traffic surface of the bridge 10. The bridge 10 is generally formed from concrete and pre-stressed through the use of a tensioning system 60, including internal tendons or tensioning members 68. As used in this application, the term pre-stressed or pre-tensioned refers to a bridge that uses tension created by tendons to increase strength and is formed from numerous adjacent pre-cast longitudinal load members 40.

As with all bridges, the bridge 10 of the present invention is supported by a support structure 20. While any support structure may be used, which vary widely in size shape and style, most bridges include an abutment (not shown) at each end for support. For concrete bridges of longer length, they may have multiple spans, or intermediate supports along a single unbroken span. These intermediate supports are piers 24, which generally include a pier foundation (not shown), at least one support column 28 extending upwardly from the pier foundation, and a pier head 30 supported by the support columns 28. The pier head 30 includes an upper support surface 32 which is configured to support the span 12 at selected intermediate locations, or near their ends.

A longitudinal load member 40 is supported by the support structure 20. Each span is the distance between adjacent support structures. A single set of laterally adjacent longitudinal load members 40 may extend across a single span from abutment to abutment, or may span across multiple spans by using intervening support piers 24. Of course, for multiple span bridges, each set of longitudinal load members 24 may abut another set at piers 24 and be aligned end to end with the other set of longitudinal load members. As stated above, intermediate supports in the form of piers 24 may also be used on single spans. The longitudinally adjacent longitudinal load members 40 are typically aligned and have a t-shape in the present invention, with the upper portion of the load members forming a deck surface 132, and eliminating the need for poured or applied on site construction, which substantially increases the construction time and cost for the bridge.

As pre-stressed concrete bridges 10 may vary widely in size, shape and style, some pre-stressed concrete bridges such as for small pedestrian bridges or other narrow bridges, only one longitudinal load member 40 may be required or two longitudinal load members laid end to end to extend across greater distances. However, most bridges having a width for at least two-way vehicular traffic, will have a plurality of laterally adjacent longitudinal load members 40, or a set of laterally adjacent load members set end to end.

The longitudinal load member 40 can have any desired size, shape or configuration. As illustrated in FIGS. 2 and 3, the longitudinal load member 40 may be formed in the shape of a T-beam 52 or similar shape. Other exemplary shapes may include other shapes such as an I-beam or double T-beam. Of course, a variety of other longitudinal load member shapes and styles may be used. The longitudinal load member 40 are pre-cast in individual spans and then shipped to the site of the bridge as increased quality control may be easily accomplished as well as control of the environmental conditions during the curing of the concrete. In comparison, changes in the environmental conditions at the site of the bridge for concrete cast on-site and limited ability to control the curing process may affect the strength and durability of the bridge and in a particular, the strength and durability of the longitudinal load members. For example, in forming a pre-cast longitudinal load member 40, environmental conditions such as temperature, humidity, and rate of use or loss of water by the cement during curing may affect the durability, longevity and load-bearing capability of the concrete. In addition, proper routing of the tendons or cables within the longitudinal load members, as discussed below, is easier to control in forming pre-cast members. As further described below, the longitudinal load member 40 is cast from at least two types of concrete, and casting such longitudinal load spans 40 on site is difficult to maintain quality control.

The longitudinal load member 40 includes a lower support surface 42 that engages the support structure 20, including abutments and if necessary piers 24, specifically the pier heads 30. More specifically, the lower support surface 42 engages the upper support surface 32 of the pier 24. The longitudinal load members 40 are the primary loading carrying members extending across the gap 14 spanned by the bridge 10. The longitudinal load members 40 further include an upper support surface 44. The upper support surface 44 forms the deck slab of the bridge or wear surface or traffic surface of the road or pathway. The illustrated T-beam or double T-beam joins at the edges.

The longitudinal load members 40 include an integral tensioning system 60. The integral tensioning system 60 includes at least one internal tendon or internal longitudinal tension member 68. The internal tendon 68 may be made from a variety of materials capable of holding or maintaining the tension load applied to the tendon without failure. Steel is commonly used for internal tendons, however, for longevity, light-weightness, and tension load characteristics, it is generally preferable to use carbon-fiber reinforced polymers (CFRP), also known as carbon-fiber reinforced plastic. Any type of carbon-fiber reinforced polymer capable of supporting the desired tension load may be used as a tendon 68.

The integral tensioning system 60 have been found to have performance benefits by following predetermined paths through the longitudinal load members 40. As illustrated in the figures, at least two paths, a first predetermined path 62 and a second predetermined path 88 may be seen. The second predetermined path 88 is substantially straight, having only minor unintended deviations from being straight. The first predetermined path 62 has a more profiled passage through the longitudinal load members 40. More specifically, the first predetermined path includes at least four distinct travel path segments, a first travel path 82 through the intermediate sections 80 being not formed of UHPC, and a second, third and fourth travel paths 72, 74, 76 all through the UHPC sections 70. The fourth travel path 76 is substantially parallel to the first travel path, with less than 10 degrees, preferably less than 5 degrees of alignment and more specifically within a degree of alignment. Of course alignment is not referring to vertical or horizontal alignment, but instead its parallel pathways that are desired. The second and third travel paths 72, 74 extend respectively between the first and fourth travel paths, 82, 76 and are angled relative and not in substantially parallel alignment. The second and third travel paths are also not in parallel alignment with each other. Of course, it is expected that the first travel path and the second travel path will be substantially in the same plane, or any such deviation from the plane will be unintentional. A cage reinforcement 78 may be included in the areas of UHPC 70 that will be proximate to or above the support structure 20.

To overcome the aforementioned challenges in precast prestressed bridge beams, the bridge 10 of the present invention uses a single span with at least a dual concrete system for each t-beam, reinforced/prestressed with corrosion-free carbon fiber reinforced polymer (CFRP) materials. The proposed system encompasses the construction of decked bulb T beams using two different concrete mixes. The first mix is an ultra-high-performance concrete (UHPC) mix with a compressive strength exceeding 137.9 Mpa (20 ksi) and tensile strength exceeding 10.34 Mpa (1.5 ksi). This mix will be used in the anchorage zones and the shear spans regions of the beams 40. The second mix is a normal-weight concrete mix, have less than a compressive strength exceeding 137.9 Mpa (20 ksi) and tensile strength exceeding 10.34 Mpa (1.5 ksi). For example, standard concrete used in bridge beams typically has a specified concrete compressive strength of 68.95 Mpa (10 ksi), with some high performance concrete mixes now being used reaching a compressive strength of 96.53 Mpa (14 ksi). The high performance is typically used for longer spans. Both mixes are formed in a single contiguous span. It is expected that the mixes will be divided substantially into discrete areas, except where the mixes meet, which may have some mixing of both mixes, preferable a limited transition area.

The conventional longitudinal and transverse steel reinforcement of the beams in the prior art will be replaced with CFRP reinforcement. In addition, prior art shear plates may be eliminated over the intermediate supports in the areas where shear is most likely to occur. While the usage of UHPC has been prohibitive due to its cost, typically 10-30 times higher than standard concrete, the inventors have surprising found that a single cast beam, having UHPC concrete in specific portions of the longitudinal load member 40, specifically proximate to the supporting structure meets all performance requirements, without the use of shear plates and in single long beam, while yet minimizing costs by avoiding the use of UHPC throughout the complete beam. The beam may be made with multiple sections of UHPC, in intermediate portions, surrounded by portions that are not UHPC.

In addition, the continuity of the beams over intermediate supports will be achieved by drapping the longitudinal prestressing strands. Consequently, the beams will be continuous for both dead and life loads and no cast-in-place deck slab will be required to achieve the continuity over intermediate supports. The transverse continuity between the adjacent beams will be achieved using: (1) full-depth transverse diaphragms and (2) cast-in-place UHPC shear keys between the top flanges of the beams. The sheer key is only used to adjoin parallel longitudinal load members and not end to end abutment.

The longitudinal load members 40 may include transverse diaphragms and will be provided with ducts to accommodate possible unbounded transverse post-tensioning strands 92.

The longitudinal load members 40 are transported individual to the site of the bridge 10, and the transverse strands 92 are tensioned after installation of the load members 40. The transverse strands 92 are configured to hold all of the longitudinal load members, together side by side so that the upper portion 43 of the t-beam abuts each other so that each upper surface 44 forms the upper surface 14 of the bridge 10.

The present invention is well suited to two-span continuous single longitudinal load members, as illustrated in FIGS. 2 and 3. More specifically, for a two span bridge, three sections of UHPC are included, sandwiching two sections of standard concrete. The present invention uses longitudinal load members that are decked bulb T beams and a two-span continuous complete bridge model. The performance of the individual beams and the bridge model as a whole has both flexural and shear loadings that exceed any requirements without the use of a bridge deck on top of the longitudinal load members 40.

As such, the present invention provides an effective bridge system designed as continuous for both dead and life loads. This system can be easily implemented in the field to accelerate bridge construction and reduce cost and traffic interruption. Second, alternating between UHPC and normal-weight concrete promotes an efficient use for materials without significant cost increase. Third, replacing conventional steel reinforcement with CFRP reinforcement is expected to eliminate all durability issues related to reinforcement corrosion and thereby extend the lifespan of the bridge and reduce future maintenance cost and effort.

The present invention reduces the impact of bridge construction on traffic by significantly reducing the construction and the future maintenance time, provides a sound infrastructure system capable of supporting the assigned loads with an adequate factor of safety, and reduces the cost of construction and maintenance over the lifespan of the bridge.

The invention claimed is:

1. A bridge comprising:

A first support structure and a second support structure;

a longitudinal load member supported by said first and second support structures, said longitudinal load member including a first and a second section being formed substantially out of ultra-high performance concrete ("UHPC") and an intermediate section of said longitudinal load member between said first and second section is formed of concrete which is not UHPC and wherein said first and second sections are disposed apart from each other on each end of said intermediate section and wherein said longitudinal load members include a plurality of longitudinally extending internal tendons along predetermined paths through each of said first, second and intermediate sections and wherein said internal tendons include at least one tendon extending along a first predetermined path, and wherein said first section is supported by said first support structure and said second section is supported by said second support structure.

2. The bridge of claim 1 wherein said first predetermined path passes through said first intermediate section along a first travel path and through said first section along a second travel path, and wherein said first and said second travel paths are angled relative to each other and are not parallel.

3. The bridge of claim 2 wherein said first predetermined path includes a third travel path through said second section and wherein said third travel path is angled relative to both of said first travel path and said second travel path.

4. The bridge of claim 3 wherein said first predetermined path includes a fourth travel path in said first and second section and wherein said fourth travel path is angled relative to said second and third travel paths.

5. The bridge of claim 3 wherein said fourth travel path is substantially parallel to said first travel path.

6. The bridge of claim 1 including a support structure having at least one abutment and wherein at least one of said first and second sections rests on said abutment.

7. The bridge of claim 6 wherein said support structure includes at least one pier, and wherein at least one of said first and said second sections rests on said pier.

8. The bridge of claim 1 further including a support structure and wherein said intermediate section is not supported by said support structure.

9. The bridge of claim 1 wherein said UHPC concrete has a compressive strength exceeding 20 ksi and tensile strength exceeding 1.5 ksi.

10. The bridge of claim 4 wherein said internal tendons include a second predetermined path and wherein said second predetermined path is substantially straight.

11. The bridge of claim 10 wherein said second predetermined path is substantially parallel to said second and said fourth travel paths.

12. The bridge of claim 1 wherein said intermediate section is formed from a concrete having a compressive strength less than 20 ksi and tensile strength less than 1.5 ksi.

13. The bridge of claim 12 wherein said intermediate section is formed from concrete having a compressive strength of 10-14 ksi.

14. The bridge of claim 1 wherein said internal tendons are prestressed tendons.

15. The bridge of claim 1 wherein said longitudinal load members are selected from the group consisting of hybrid decked bulb t-beams, hybrid decked bulb double t-beams and hybrid decked pi beams.

16. The bridge of claim 1 wherein said longitudinal load members form the traffic surface and wherein said bridge is free of a separate cast in place deck slab.

17. The bridge of claim 1 wherein said intermediate section forms no more than 70% of the longitudinal load members.

18. The bridge of claim 17 wherein said intermediate section forms no more than 80% of said longitudinal load members.

19. The bridge of claim 18 wherein said intermediate section forms no more than 85% of said longitudinal load members.

* * * * *